US010221707B2

(12) United States Patent
Paradis et al.

(10) Patent No.: US 10,221,707 B2
(45) Date of Patent: Mar. 5, 2019

(54) INTEGRATED STRUT-VANE

(71) Applicant: Pratt & Whitney Canada Corp., Longueuil (CA)

(72) Inventors: Vincent Paradis, Longueuil (CA); Edward Vlasic, Beaconsfield (CA); Panagiota Tsifourdaris, Montreal (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 667 days.

(21) Appl. No.: 13/788,474

(22) Filed: Mar. 7, 2013

(65) Prior Publication Data

US 2014/0255159 A1 Sep. 11, 2014

(51) Int. Cl.
*F01D 5/14* (2006.01)
*F01D 9/02* (2006.01)
*F01D 25/16* (2006.01)

(52) U.S. Cl.
CPC ..... *F01D 9/02* (2013.01); *F01D 5/146* (2013.01); *F01D 25/162* (2013.01)

(58) Field of Classification Search
CPC ... F01D 9/02; F01D 9/041; F01D 1/02; F01D 1/04; F01D 9/047; F01D 5/146; F01D 9/04; F01D 9/042; F01D 25/162
USPC .... 415/191, 208.1, 208.2, 208.4, 211.2, 115, 415/116, 193, 194, 209.1
See application file for complete search history.

(56) References Cited

U.S. PATENT DOCUMENTS 3,604,629 A 9/1971 Colville
3,617,147 A 11/1971 Bragg
3,704,075 A * 11/1972 Karstensen ..... F01D 9/041 415/131
3,745,629 A * 7/1973 Pask et al. ..... 29/889.22
4,478,551 A 10/1984 Honeycutt, Jr. et al.
4,595,340 A 6/1986 Klassen et al.
4,793,770 A 12/1988 Schonewald et al.
4,989,406 A * 2/1991 Vdoviak ..... F01D 25/162 244/117 A (Continued)

FOREIGN PATENT DOCUMENTS

EP 2206885 7/2010
GB 1058759 * 11/1964

(Continued)

OTHER PUBLICATIONS

Partial European Search Report, dated Apr. 22, 2014.

(Continued)

*Primary Examiner* — Alexander B Comley
(74) *Attorney, Agent, or Firm* — Norton Rose Fulbright Canada LLP

(57) ABSTRACT

An integrated strut and turbine vane nozzle (ISV) has inner and outer annular duct walls defining an annular flow passage therebetween. Circumferentially spaced-apart struts extend radially across the flow passage. Circumferentially spaced-apart vanes also extend radially across the flow passage and define a plurality of inter-vane passages. Each of the struts is integrated to an associated one of the vanes to form therewith an integrated strut-vane airfoil. The inter-vane passages on either side of the integrated strut-vane airfoil may be adjusted for aerodynamic considerations. The vanes may be made separately from the struts and manufactured such as to cater for potential misalignments between the parts.

8 Claims, 6 Drawing Sheets

(56) References Cited

U.S. PATENT DOCUMENTS

| | | | | |
|---|---|---|---|---|
| 5,207,556 | A | 5/1993 | Frederick et al. | |
| 6,045,325 | A * | 4/2000 | Horvath | F01D 5/148 277/637 |
| 6,082,966 | A | 7/2000 | Hall et al. | |
| 6,331,100 | B1 | 12/2001 | Liu et al. | |
| 6,331,217 | B1 | 12/2001 | Burke et al. | |
| 6,439,838 | B1 * | 8/2002 | Crall et al. | 415/119 |
| 6,619,916 | B1 * | 9/2003 | Capozzi et al. | 415/160 |
| 6,851,264 | B2 | 2/2005 | Kirtley et al. | |
| 6,883,303 | B1 | 4/2005 | Seda | |
| 6,983,608 | B2 | 1/2006 | Allen, Jr. et al. | |
| 7,055,304 | B2 * | 6/2006 | Courtot et al. | 60/39.093 |
| 7,097,420 | B2 * | 8/2006 | Cormier et al. | 415/119 |
| 7,134,838 | B2 | 11/2006 | Dube et al. | |
| 7,238,003 | B2 | 7/2007 | Synnott et al. | |
| 7,322,797 | B2 | 1/2008 | Lee et al. | |
| 7,544,040 | B2 * | 6/2009 | Marke et al. | 415/142 |
| 7,549,839 | B2 | 6/2009 | Carroll et al. | |
| 7,553,129 | B2 | 6/2009 | Hoeger et al. | |
| 7,753,652 | B2 | 7/2010 | Truckenmueller et al. | |
| 7,824,152 | B2 | 11/2010 | Morrison | |
| 7,985,053 | B2 | 7/2011 | Schott et al. | |
| 8,061,969 | B2 | 11/2011 | Durocher et al. | |
| 8,091,371 | B2 | 1/2012 | Durocher et al. | |
| 8,096,746 | B2 | 1/2012 | Durocher et al. | |
| 8,099,962 | B2 | 1/2012 | Durocher et al. | |
| 8,152,451 | B2 | 4/2012 | Manteiga | |
| 8,177,488 | B2 | 5/2012 | Manteiga | |
| 8,182,204 | B2 | 5/2012 | Durocher et al. | |
| 8,192,153 | B2 | 6/2012 | Harvey et al. | |
| 8,197,196 | B2 | 6/2012 | Davis et al. | |
| 8,245,518 | B2 | 8/2012 | Durocher et al. | |
| 8,371,812 | B2 | 2/2013 | Manteiga | |
| 8,425,185 | B2 | 4/2013 | Myoren et al. | |
| 8,684,684 | B2 | 4/2014 | Clements et al. | |
| 8,979,499 | B2 | 3/2015 | Allen-Bradley | |
| 8,997,494 | B2 | 4/2015 | Chuang et al. | |
| 9,115,588 | B2 | 8/2015 | Nash | |
| 9,133,713 | B2 | 9/2015 | Allen-Bradley | |
| 9,175,693 | B2 | 11/2015 | Dutka et al. | |
| 9,243,511 | B2 | 1/2016 | Lee et al. | |
| 9,249,736 | B2 | 2/2016 | Carroll | |
| 9,284,845 | B2 | 3/2016 | Lewis et al. | |
| 2006/0018760 | A1 | 1/2006 | Bruce et al. | |
| 2006/0024158 | A1 | 2/2006 | Hoeger et al. | |
| 2007/0092372 | A1 * | 4/2007 | Carroll et al. | 415/191 |
| 2009/0155068 | A1 | 6/2009 | Durocher et al. | |
| 2009/0155069 | A1 | 6/2009 | Durocher et al. | |
| 2009/0324400 | A1 | 12/2009 | Marini et al. | |
| 2010/0080699 | A1 | 4/2010 | Pietrobon et al. | |
| 2010/0111690 | A1 | 5/2010 | Heriz Agiriano et al. | |
| 2010/0132371 | A1 | 6/2010 | Durocher et al. | |
| 2010/0132377 | A1 | 6/2010 | Durocher et al. | |
| 2010/0166543 | A1 | 7/2010 | Carroll | |
| 2010/0272566 | A1 * | 10/2010 | Durocher | F01D 9/06 415/208.2 |
| 2010/0275572 | A1 | 11/2010 | Durocher et al. | |
| 2013/0084166 | A1 | 4/2013 | Klingels | |
| 2013/0142660 | A1 | 6/2013 | McCaffrey | |
| 2013/0259672 | A1 * | 10/2013 | Suciu | F01D 1/04 415/208.1 |
| 2013/0330180 | A1 | 12/2013 | Guendogdu et al. | |
| 2014/0314549 | A1 | 10/2014 | Pakkala et al. | |
| 2015/0044032 | A1 | 2/2015 | Paradis | |
| 2015/0132054 | A1 | 5/2015 | Dreischarf | |
| 2015/0260103 | A1 | 9/2015 | Yu et al. | |
| 2016/0281509 | A1 | 9/2016 | Pons et al. | |

FOREIGN PATENT DOCUMENTS

| | | |
|---|---|---|
| GB | 1058759 | 2/1967 |
| GB | 1534124 | 11/1978 |
| GB | 1534124 A * | 11/1978 |
| GB | 2226600 | 7/1990 |

OTHER PUBLICATIONS

European Search Report, dated Nov. 28, 2014.

International Search Report dated Oct. 6, 2016 in PCT application No. PCT/CA2016/050801.

Notice of allowance issued in related U.S. Appl. No. 13/961,136 dated Aug. 2, 2017.

Non-Final Office Action dated Jul. 13, 2016 in related U.S. Appl. No. 13/961,136.

* cited by examiner

INTEGRATED STRUT-VANE

TECHNICAL FIELD

The application relates generally to gas turbine engines and, more particularly, to an integrated strut and vane nozzle.

BACKGROUND OF THE ART

Gas turbine engine ducts may have struts in the gas flow path, as well as vanes for guiding a gas flow through the duct. Conventionally, the struts are axially spaced from the vanes to avoid flow separation problems. This results in longer engine configurations. In an effort to reduce the engine length, it has been proposed to integrate the struts to the vanes. However, known techniques for manufacturing integrated strut-vane structures are relatively complex and provide little flexibility for adjusting the flow of the vane nozzle.

SUMMARY

In one aspect, there is provided an integrated strut and turbine vane nozzle (ISV) comprising: inner and outer annular duct walls concentrically disposed about an axis and defining an annular flow passage therebetween, an array of circumferentially spaced-apart struts extending radially across the flow passage, an array of circumferentially spaced-apart vanes extending radially across the flow passage and defining a plurality of inter-vane passages, each inter-vane passage having a throat, the vanes having leading edges disposed downstream of leading edges of the struts relative to a direction of gas flow through the annular flow passage, each of the struts being angularly aligned in the circumferential direction with an associated one of the vanes and forming therewith an integrated strut-vane airfoil, the vanes and the integrated strut-vane airfoils having substantially the same shape for the airfoil portions extending downstream from the throat of each of the inter-vane passages.

In a second aspect, there is provided an integrated strut and turbine vane nozzle (ISV) comprising: axially mating forward and aft duct sections having respective inner and outer duct walls defining an annular flow passage therebetween, an array of circumferentially spaced-apart struts extending radially across the flow passage, an array of circumferentially spaced-apart vanes extending radially across the flow passage, the vanes having leading edges disposed downstream of leading edges of the struts relative to a direction of gas flow through the annular flow passage, each of the struts being angularly aligned in the circumferential direction with an associated one of the vanes and forming therewith an integrated strut-vane airfoil having opposed pressure and suctions sidewalls, the integrated strut-vane airfoil having steps formed in the opposed pressure and suctions sidewalls at an interface between the strut and vane of the integrated strut-vane airfoil.

DESCRIPTION OF THE DRAWINGS

Reference is now made to the accompanying figures, in which.

DETAILED DESCRIPTION

Figure 1:
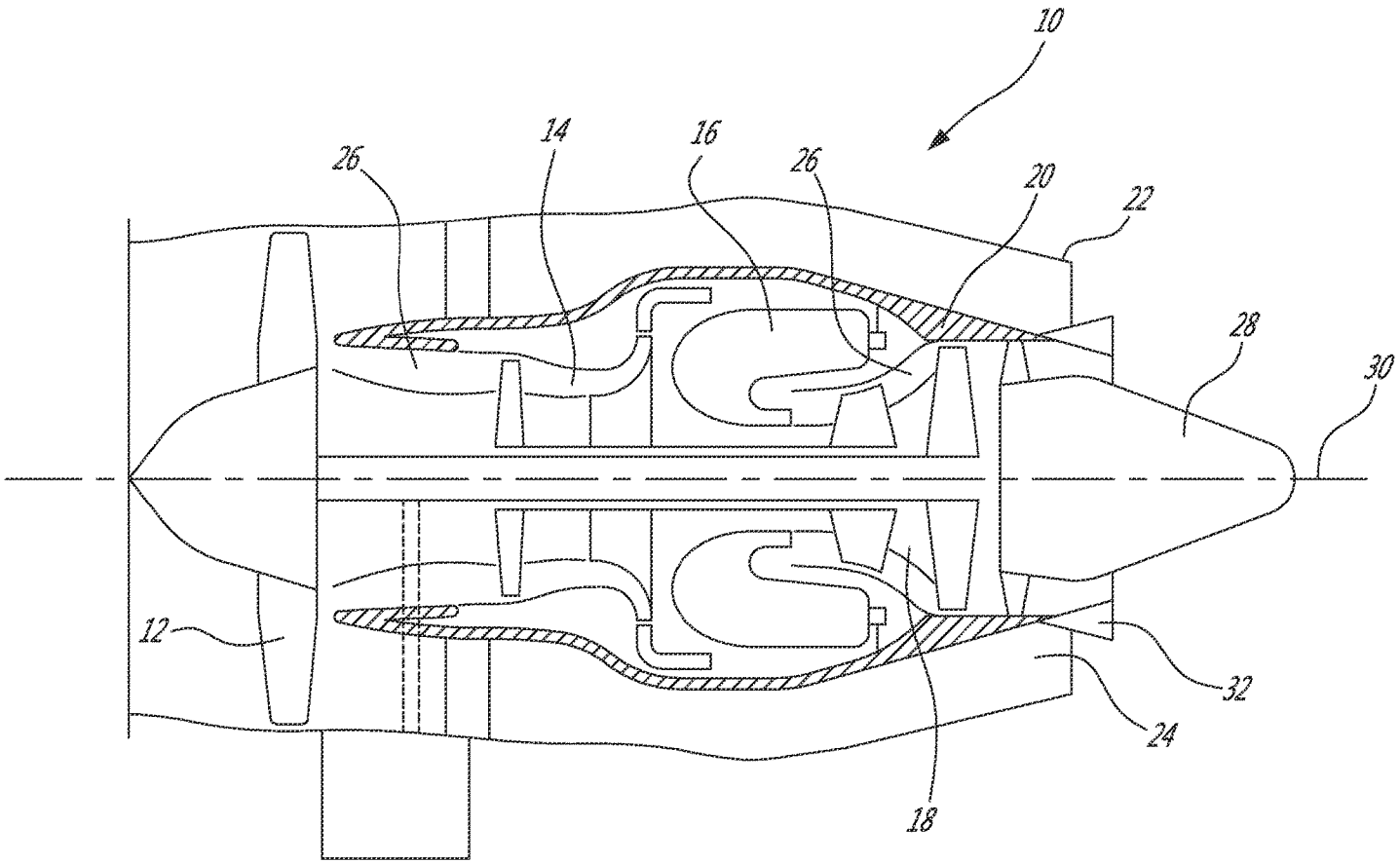
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

The gas turbine engine 10 includes a first casing 20 which encloses the turbo machinery of the engine, and a second, outer casing 22 extending outwardly of the first casing 20 such as to define an annular bypass passage 24 therebetween. The air propelled by the fan 12 is split into a first portion which flows around the first casing 20 within the bypass passage 24, and a second portion which flows through a core flow path 26 which is defined within the first casing 20 and allows the flow to circulate through the multistage compressor 14, combustor 16 and turbine section 18 as described above.

Figure 2:
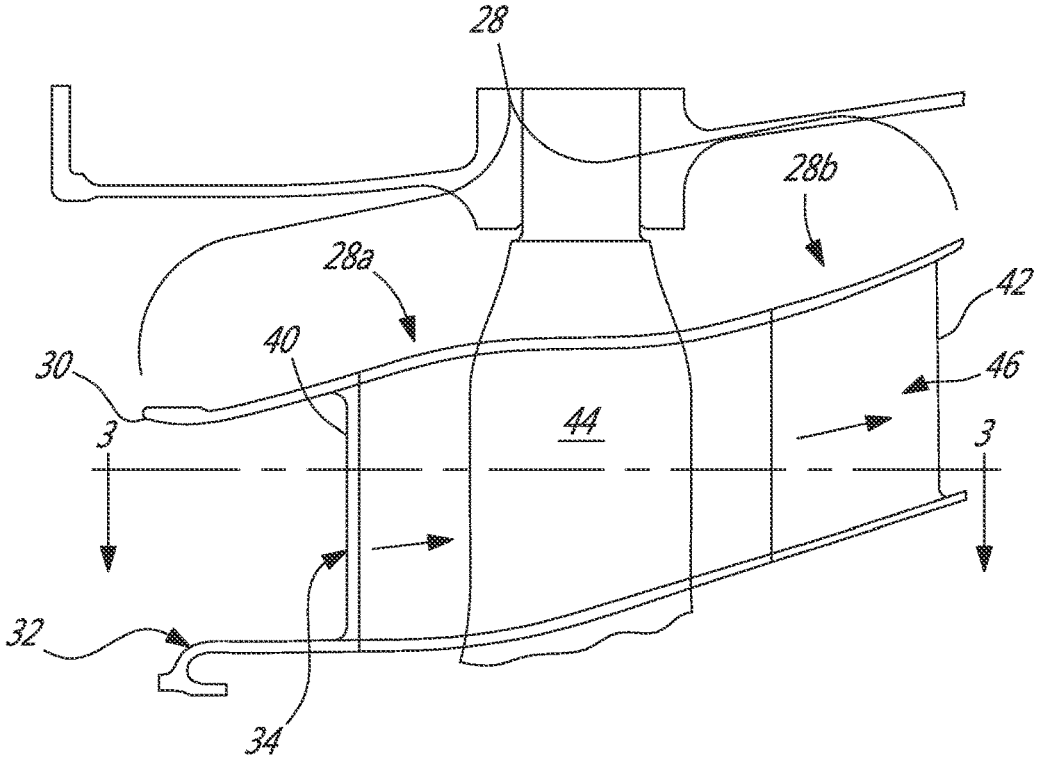
FIG. 2 is a cross-sectional view of an integrated strut and turbine vane nozzle (ISV) suitable for forming a portion of the turbine engine gaspath of the engine shown in FIG. 1.

FIG. 2 shows an integrated strut and turbine vane nozzle (ISV) 28 suitable for forming a portion of the core flow path 26 of the engine 10. For instance, ISV could form part of a mid-turbine frame system for directing a gas flow from a high pressure turbine assembly to a low pressure turbine assembly. However, it is understood that the ISV 28 could be used in other sections of the engine. Also it is understood that the ISV 28 is not limited to turbofan applications. Indeed, the ISV could be installed in other types of gas turbine engines, such as turboprops, turboshafts and auxiliary power units (APUs).

As will be seen hereinafter, the ISV 28 may be of unitary construction or it may be an assembly of multiple parts. The ISV 28 generally comprises a radially outer duct wall 30 and a radially inner duct wall 32 concentrically disposed about the engine axis 30 (FIG. 1) and defining an annular flow passage 32 therebetween. The annular flow passage 32 defines an axial portion of the core flow path 26 (FIG. 1).

Figure 3:
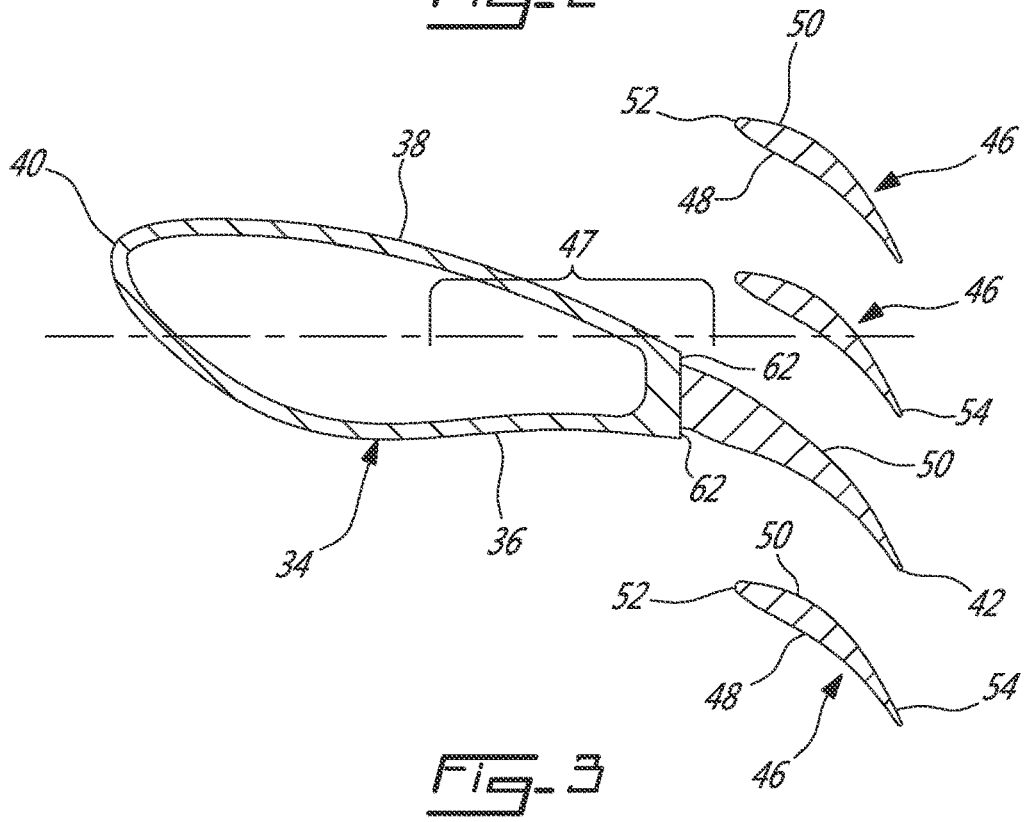
FIG. 3 is a cross-sectional view taken along line 3-3 in FIG. 2.
Figure 4:
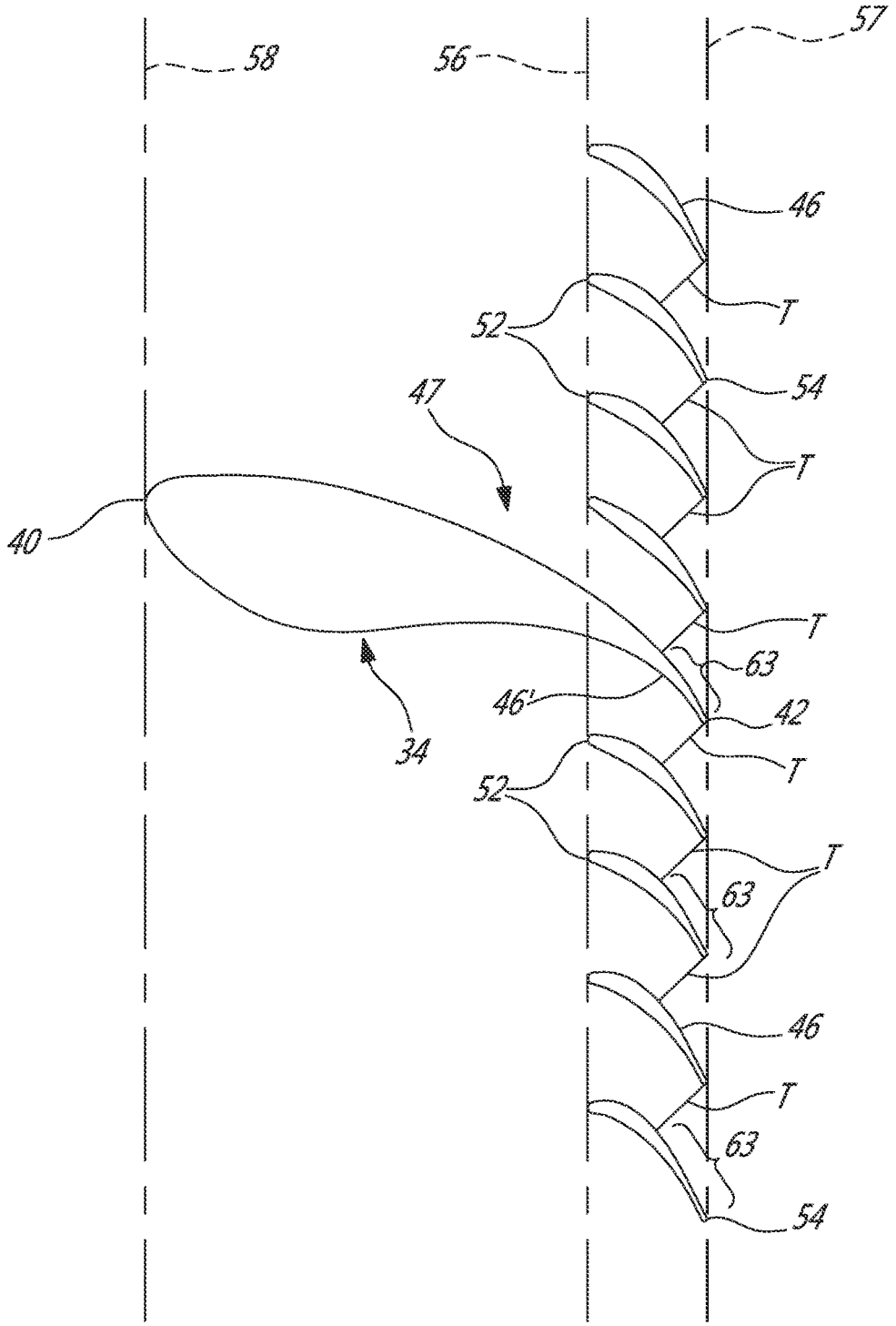
FIG. 4 is a circumferentially extended schematic partial view illustrating an ISV with identical throats and identical airfoil shape downstream from the throats.

Referring concurrently to FIGS. 2 to 4, it can be appreciated that a plurality of circumferentially spaced-apart struts 34 (only one shown in FIGS. 2 to 4) extend radially between the outer and inner duct walls 30, 32. The struts 34 may have a hollow airfoil shape including a pressure sidewall 36 and a suction sidewall 38. Support structures 44 and/or service lines (not shown) may extend internally through the hollow struts 34. The struts 34 may be used to transfer loads and/or protect a given structure (e.g. service lines) from the high temperature gases flowing through the flow passage 32. The ISV 28 has at a downstream end thereof a guide vane nozzle section including a circumferential array of vanes 46 for directing the gas flow to an aft rotor (not shown). The vanes 46 have an airfoil shape and extend radially across the flow passage 32 between the outer and inner duct walls 30, 32. The vanes 46 have opposed pressure and suction side walls 48 and 50 extending axially between a leading edge 52 and a trailing edge 54. As depicted by line 56 in FIG. 4, the leading edges 52 of the vanes 46 are disposed in a common radially extending plane (i.e. the leading edges 52 are axially aligned) downstream (relative to a direction of the gas flow through the annular flow passage 32) of the radial plane 58 defined by the leading edges 40 of the struts 34. The trailing edges 54 of the vanes 46 and the trailing edges 42 of the struts 34 extend to a common radial plane depicted by line 57 in FIG. 4.

Each strut 34 is angularly aligned in the circumferential direction with an associated one of the vanes 46 to form an integrated strut-vane airfoil 47 (FIG. 3). The integration is made by combining the airfoil shape of each strut 34 with the airfoil shape of the associated vane 46'. Accordingly, each of the struts 34 merges in the downstream direction into a corresponding one of the vanes 46 of the array of guide vanes provided at the downstream end of the flow passage 32. As can be appreciated from FIGS. 3 and 4, the pressure and suctions sidewalls 48 and 50 of the vanes 46', which are aligned with the struts 34, extend rearwardly generally in continuity to the corresponding pressure and suction sidewalls 36 and 38 of respective associated struts 34.

The integrated strut-vane airfoils 47 may be integrally made into a one-piece/unitary structure or from an assembly of multiple pieces. For instance, as shown in FIGS. 2, 3 and 7, the ISV 28 could comprise axially mating forward and aft annular duct sections 28*a* and 28*b*, the struts and the vanes respectively forming part of the forward and aft annular duct sections 28*a*, 28*b*. FIG. 8 illustrates an example of an aft annular duct section 28*b* including a circumferential array of vanes 46 extending radially between outer and inner annular duct wall sections 30*b*, 32*b*. It can be appreciated that the vanes 46' to be integrated to the associated struts 34 on the forward annular duct section 28*a* extend forwardly of the other vanes 46 to the upstream edge of the outer and inner duct wall sections 30*b*, 32*b*. The forward end of vanes 46' is configured for mating engagement with a corresponding aft end of an associated strut 34. Accordingly, as schematically depicted by line 60 in FIG. 6, the interface between the struts 34 and the associated vanes 46' will be disposed axially upstream of the leading edges 52 of the other guide vanes 46. Such an axially split ISV arrangement allows for the production of the guide vane portion separately. In this way different classes (parts with different airfoil angles) can be produced to allow for engine flow adjustment without complete ISV de-assembly. It provides added flexibility to adjust the flow of the vanes nozzle section.

Figure 9:
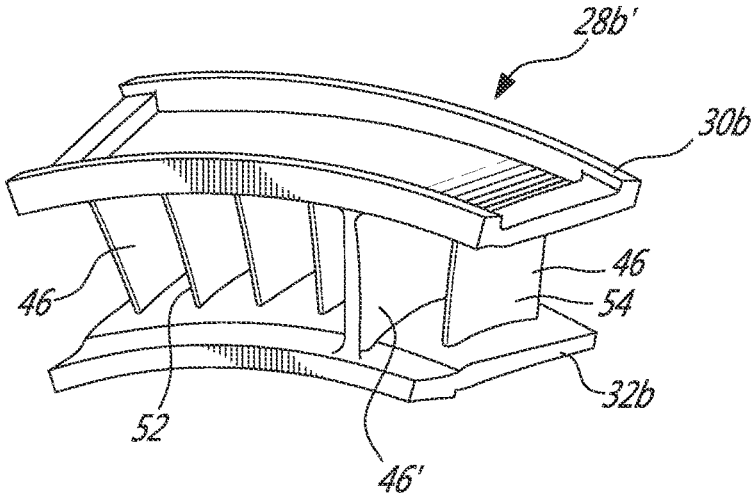
FIG. 9 is an isometric view a segment which may form part of a circumferentially aft vane nozzle section adapted to be assembled to a forward annular duct section to form a multi-piece ISV.

It is noted that the vane nozzle section (i.e. the aft duct section 28*b*) may be provided in the form of a unitary circumferentially continuous component (FIG. 8) or, alternatively, it can be circumferentially segmented. FIG. 9 illustrates an example of a vane nozzle segment 28*b*' that could be assembled to other similar segments to form a circumferentially complete vane nozzle section of the ISV 28.

Figure 6:
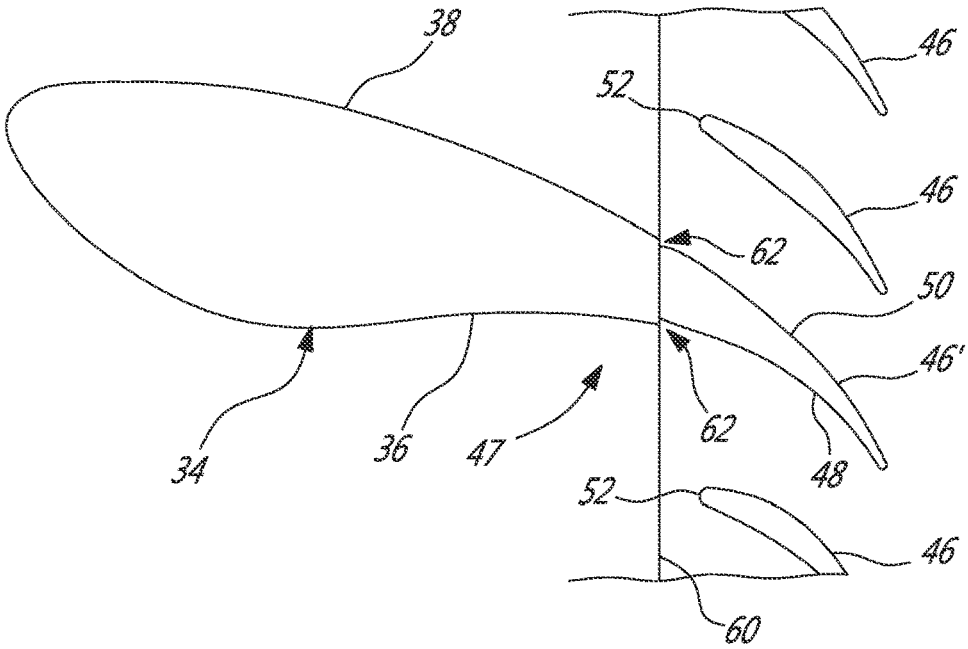
FIG. 6 is a circumferentially extended schematic partial view illustrating a two-part integrated strut/vane assembly with steps at the interface between the strut and the associated vane to cater for tolerances.
Figure 7:
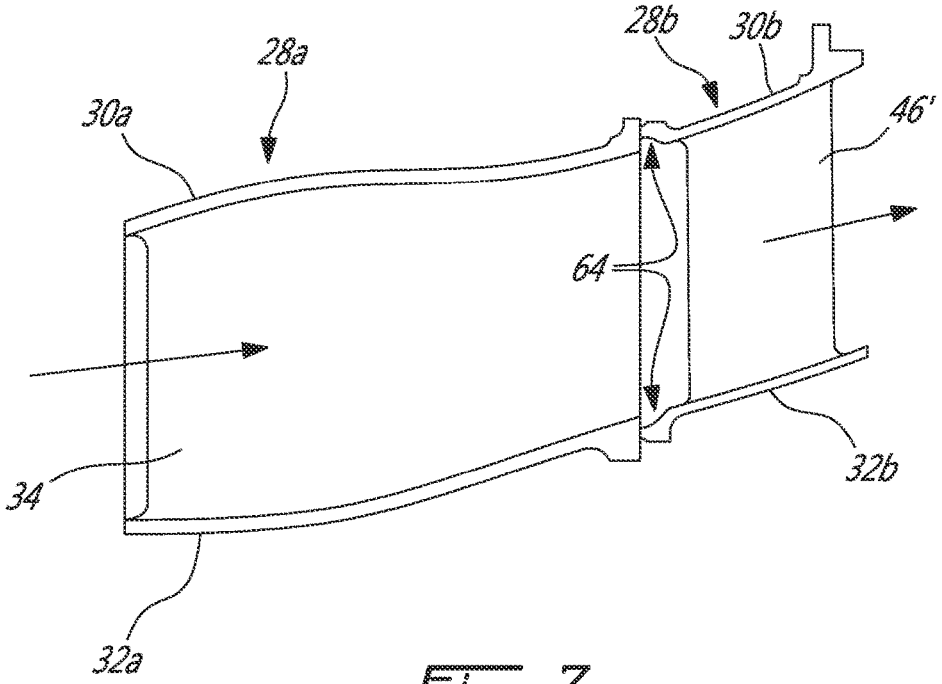
FIG. 7 is a schematic cross-sectional view illustrating the interface in a radial plane between a two-part strut/vane of the ISV.
Figure 8:
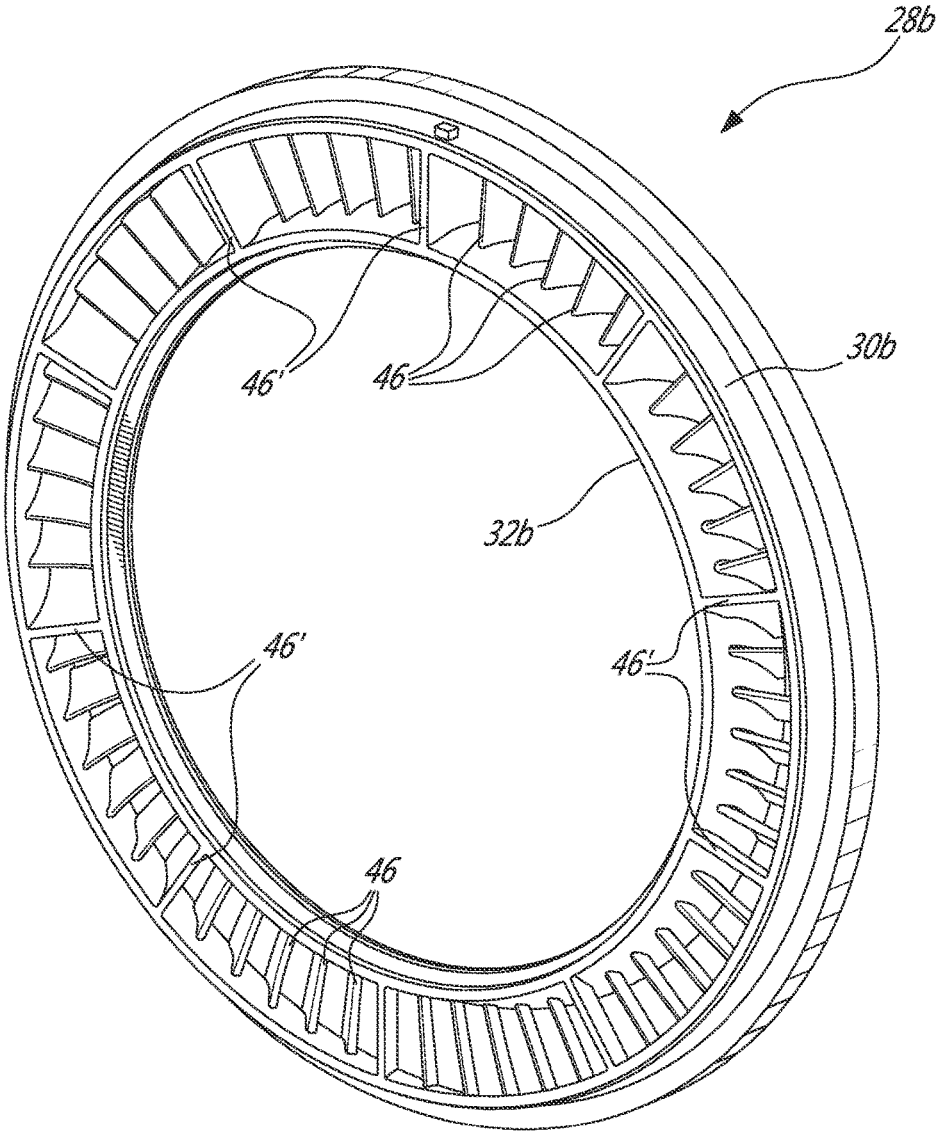
FIG. 8 is a front isometric view of a unitary aft vane nozzle section for mating engagement with a forward annular duct section to form therewith an axially split ISV.

As shown in FIGS. 6 and 7, steps may be created at the interface between the struts and the vane portions of the integrated strut-vane airfoil 47 and into the flow passage 32 to cater for tolerances (avoid dam creation resulting from physical mismatch between parts) while minimizing aerodynamic losses. More particularly, at the interface 60, the strut 34 is wider in the circumferential direction than the associated vane 46'. In other words, at the interface 60, the distance between the pressure and suction sidewalls 36, 38 of the strut 34 is greater than the distance between the pressure and suction sidewalls 48, 50 of the vane 46'. This provides for the formation of inwardly directed steps 62 (sometimes referred to as waterfall steps) on the pressure and suction sidewalls of the integrated strut-vane airfoil 47. It avoids the pressure or suction sidewalls 48, 50 of the vane 46' from projecting outwardly in the circumferential direction relative to the corresponding pressure and suctions sidewalls 36, 38 of the strut 34 as a result of a mismatch between the parts.

As shown in FIG. 7, "waterfall" steps 64 are also provided in the flow surfaces of the outer and inner duct walls 30 and 32 at the interface between the forward and aft duct sections 28*a* and 28*b*. The annular front entry portion of the flow passage defined between the outer and inner wall sections 30*b*, 32*b* of the aft duct section 28*b* has a greater cross-sectional area than that of the corresponding axially mating rear exit portion of the flow passage section defined between the outer an inner wall sections 30*a*, 32*a* of the forward duct section 28*a*. This provides flexibility to accommodate radial misalignment between the forward and aft duct sections 28*a*, 28*b*. It prevents the creation of an inwardly projecting step or dam in the flow passage 32 at the interface between the forward and aft duct sections 28*a*, 28*b* in the event of radial misalignment.

Now referring back to FIG. 4, it can be appreciated that inter-vane flow passages are formed between each vanes 46, 46'. Each inter-vane passage has a throat T. The throat T corresponds to the smallest annulus area between two adjacent airfoils. The integration of the struts 34 with respective associated vanes 46' (irrespective of the unitary of multi-part integration thereof) can be made such that the aft portions 63 of all vanes, including vane 46 and 46', have identical shapes aft of the throat T (i.e. the portion of the vanes extending downwardly from the throats are identical). This allows for equal inter-vane throat areas around all the circumference of the annular flow passage 32, including the throat areas on each side of the integrated strut-vane airfoils 47. This results in equalized mass flow distribution, minimized aerodynamic losses, reduced static pressure gradient and minimized strut wake at the exit of the guide vane. It is therefore possible to reduce engine length by positioning the aft rotor closer to the vanes.

Figure 5:
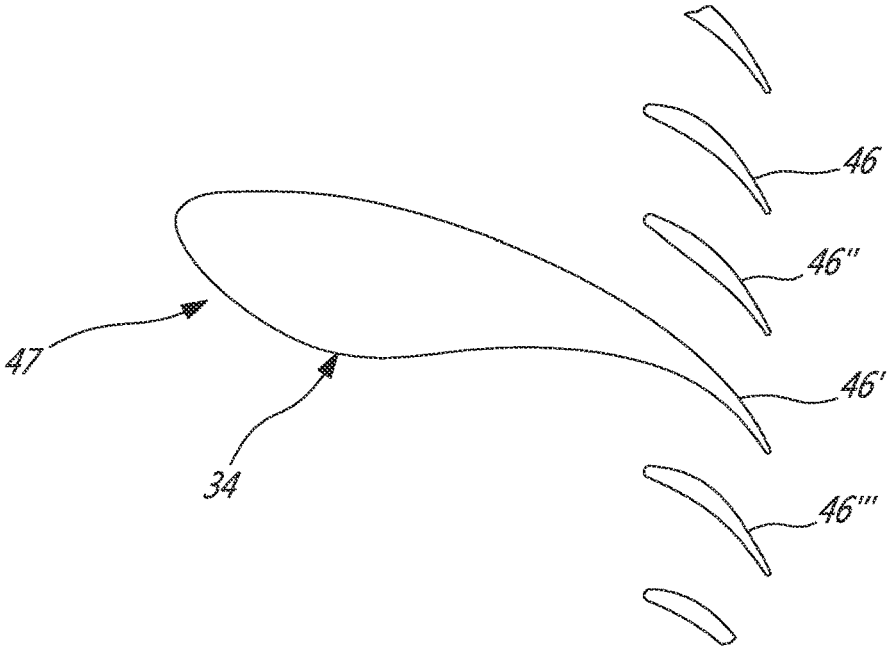
FIG. 5 is a circumferentially extended schematic partial view illustrating an ISV in which one or both of the vanes adjacent to an integrated strut-vane airfoil has an airfoil shape which is different from the other vanes.

Also as shown in FIG. 5, one or both of the vanes 46" and 46'" adjacent to the integrated strut-vane airfoil 47 can have a different airfoil shape and/or throat to adjust the mass flow distribution and better match the strut transition. In the illustrated embodiment, only vane 46" has a different shape. All the other vanes 46 have identical airfoil shapes. In addition, the adjacent vanes 46" and 46'" on opposed sides of the integrated strut-vane airfoil 47 can be re-staggered (modifying the stagger angle defined between the chord line of the vane and the turbine axial direction) to provide improved aerodynamic performances.

The above description is meant to be exemplary only, and one skilled in the art will recognize that changes may be made to the embodiments described without departing from the scope of the invention disclosed. It is also understood that various combinations of the features described above are contemplated. For instance, different airfoil designs could be provided on either side of each integrated strut-vane airfoil in combination with a re-stagger of the vanes adjacent to the integrated airfoil structure. These features could be implemented while still allowing for the same flow to pass through each inter-vane passage. Still other modifications which fall within the scope of the present invention will be apparent to those skilled in the art, in light of a review of this disclosure, and such modifications are intended to fall within the appended claims.

What is claimed is:

1. An integrated strut and turbine vane nozzle (ISV) comprising: axially mating forward and aft duct sections having respective inner and outer duct walls defining an annular flow passage therebetween, an array of circumferentially spaced-apart struts extending radially across the flow passage, an array of circumferentially spaced-apart vanes extending radially across the flow passage, the vanes having leading edges disposed downstream of leading edges of the struts relative to a direction of gas flow through the annular flow passage, each one of the struts being angularly aligned in the circumferential direction with an associated one of the vanes and forming therewith an integrated strut-vane airfoil having opposed pressure and suction sidewalls extending between a leading edge and a trailing edge of the strut-vane airfoil, the array of vanes including non-aligned vanes which are non-integrated with the struts, the pressure and suction sidewalls of the integrated strut-vane airfoil defining a camber line therebetween, an aft radially extending surface of the strut abutting a forward radially extending surface of the associated vane thereby defining an interface therebetween within the annular flow passage, the interface extending in a plane such that the circumferential direction lies in the plane, the aft surface at the plane defining a first width in the circumferential direction, the forward surface at the plane defining a second width in the circumferential direction, the first width being greater than the second width, wherein, at the interface, the pressure sidewall and the suction sidewall each defines an inwardly extending step toward the camber line when viewed in a direction extending from the leading edge toward the trailing edge.

2. The ISV defined in claim 1, wherein the interface is disposed upstream of the leading edges of the vanes.

3. The ISV defined in claim 2, wherein the struts and the vanes respectively form part of the forward and aft duct sections, and wherein the associated vanes to be integrated to the struts extend upstream of the non-aligned vanes.

4. The ISV defined in claim 3, wherein the aft duct section is circumferentially segmented.

5. The ISV defined in claim 1, wherein the inner and outer duct walls of the aft duct section define a front entry passage portion having an annular cross-sectional area which is greater than a corresponding annular cross-sectional area of an axially adjoining rear exit passage portion defined between the inner and outer duct walls of the forward duct section, thereby forming a stepped cross-sectional flow passage increase at the junction between the forward and aft duct sections.

6. The ISV defined in claim 1, wherein the vanes define a plurality of inter-vane passages, each inter-vane passage having a throat, and wherein the throat of the inter-vane passages on either side of each integrated strut-vane airfoil is identical to the throats of the other inter-vane passages.

7. The ISV defined in claim 1, wherein at least one of the non-aligned vanes adjacent to each of the integrated strut-vane airfoils has an airfoil shape which is different from an airfoil shape of another non-aligned vane.

8. The ISV defined in claim 1, wherein at least one of the non-aligned vanes adjacent to each of the integrated strut-vane airfoils has a stagger angle which is different from a stagger angle of another non-aligned vane.

* * * * *